United States Patent [19]

Bruning et al.

[11] Patent Number: 4,961,723

[45] Date of Patent: Oct. 9, 1990

[54] CENTRIFUGE DRUM FOR CLARIFYING OR SEPARATING CENTRIFUGATES

[75] Inventors: Paul Bruning; Wilfried Mackel, both of Oelde; Ulrich Wrede, Ennigerloh-Ostenfelde; Willi Niemerg, Oelde, all of Fed. Rep. of Germany

[73] Assignee: Westfalia Separator AG, Oelde, Fed. Rep. of Germany

[21] Appl. No.: 307,191

[22] Filed: Feb. 6, 1989

Related U.S. Application Data

[63] Continuation of Ser. No. 85,426, Aug. 14, 1987, abandoned.

[30] Foreign Application Priority Data

Aug. 16, 1986 [DE] Fed. Rep. of Germany ..... 3627826

[51] Int. Cl.[5] ..... B04B 11/00

[52] U.S. Cl. ..... 494/56; 494/70

[58] Field of Search ..... 494/3, 27, 61, 56, 57, 494/58, 68, 70, 71, 72, 43; 210/781, 782, 360.1

[56] References Cited

U.S. PATENT DOCUMENTS

| | | | |
|---|---|---|---|
| 2,084,487 | 6/1937 | Haraldson | 494/56 |
| 2,667,338 | 1/1954 | Hemfort | 494/56 X |
| 3,322,336 | 5/1967 | Lohse | 494/56 X |
| 3,410,481 | 11/1968 | Dahlberg | 494/56 X |
| 3,468,475 | 9/1969 | Thylefors | 494/56 X |
| 3,784,092 | 1/1974 | Gibson | 494/49 X |
| 3,986,663 | 10/1976 | Jonsson | 494/3 |
| 4,149,668 | 4/1979 | Zurbruggen | 494/56 X |
| 4,160,521 | 7/1979 | Lindgren | 494/56 |
| 4,339,072 | 7/1982 | Hiller | 494/56 X |
| 4,695,270 | 9/1987 | Zettier | 494/56 X |
| 4,729,759 | 3/1988 | Krook | 494/4 |

FOREIGN PATENT DOCUMENTS

| | | | |
|---|---|---|---|
| 15238 | 6/1906 | Norway | 494/43 |

*Primary Examiner*—Harvey C. Hornsby
*Assistant Examiner*—Scott J. Haugland
*Attorney, Agent, or Firm*—Sprung Horn Kramer & Woods

[57] ABSTRACT

The intake space of a centrifuge drum is divided into a vestibule with ribs and an intake chamber without ribs. The vestibule communicates with the intake chamber through an annular gap between the outside diameter of a disk secured to an intake pipe and the inside diameter of the intake space. The intake chamber communicates with a set of disks through channels. The diameter $D_K$ of the intake chamber at the level of the channels is longer than the diameter $D_F$ that must be maintained at the upper surface of the centrifugate in a skimming chamber during operation. Since the incoming centrifugate does not rotate in the intake chamber and since no rotational pressure is accordingly generated, the intake pressure in the intake pipe is transmitted when the intake chamber is full to the centrifugate in the intake chamber, until the requisite level of centrifugate in the skimming chamber is attained. The pressure that is transmitted to the annular gap is compensated for by the rotational pressure of the centrifugate in the vestibule, allowing absolutely smooth distribution of the centrifugate when the intake chamber is full throughout the whole operational range of the drum.

6 Claims, 3 Drawing Sheets

CENTRIFUGE DRUM FOR CLARIFYING OR SEPARATING CENTRIFUGATES

This application is a continuation, now abandoned of application Ser. No. 085,426, filed 8/14/87.

BACKGROUND OF THE INVENTION

The present invention relates to a centrifuge drum for clarifying or separating centrifugates, with at least one skimmer accommodated in a skimming chamber to divert the clarified or separated liquids and with a stationary intake pipe extending through an intake space that rotates along with the drum and consists of a vestibule and of an intake chamber, whereby the intake chamber communicates with the separation space in the drum through channels, resulting in a choking effect that extensively fills the intake chamber.

A centrifuge drum of this type is known from German Patent No. 3 019 737. It allows the centrifugate to be supplied gently. It has for that purpose choking structures that extensively fill the intake chamber at a prescribed intake flow. There are, however, drawbacks to this known drum. Even a slight variation in the prescribed intake flow will either prevent the intake chamber from filling or will cause it to overflow, because the resistance produced by the choking structures varies with the square of the flow. Since centrifuge drums of the same size are operated at a wide range of outputs, it is necessary to keep a wide selection of choking structures on hand. The intake pipe and the intake chamber must also be adapted to the particular intake flow because it is necessary to maintain minimum flow rates. These drawbacks, furthermore, are unavoidable when the intake flow varies while the drum is in operation.

SUMMARY OF THE INVENTION

The object of the present invention is to improve a centrifuge drum of the aforesaid type to the extent that the intake chamber will be completely full over the entire output range.

This object is attained in accordance with the invention in that the diameter $D_K$ of the intake chamber will be longer in the vicinity of the channels than the diameter $D_F$ of the surface of the liquid in the skimming chamber that must be maintained during operation, and in that there is an annular gap between the vestibule and the intake chamber demarcated by the outside diameter of a disk 18 secured to the intake pipe and by the inside diameter of the intake space, whereby the vestibule contains ribs.

The choking effect derives in this case not from constrictions in the channels, but on the compulsory shift in the level of liquid in the skimming chamber until the diameter at is surface becomes shorter than the diameter of the intake chamber at the level where the channels lead out of it. Since there are no ribs in the intake chamber, the centrifugate flowing through it will not rotate at the same speed as the drum, and the rotary pressure that shifts the level of liquid in the skimming chamber of known drums will be absent. The only pressure acting will be the static pressure of the liquid in the intake chamber imposed on it by the incoming centrifugate. Since, on the other hand there will be rotary pressure in the ribbed vestibule, the vestibule will fill only until the liquid pressure generated at the annular gap between the disk and the inside diameter of the intake chamber precisely equals the pressure generated at the same point by the unribbed intake chamber. Since the resistance to flow through the drum depends on the output, it must be kept as low as possible.

Diameter $D_K$ will preferably be long enough to ensure the desired inflow pressure at the diameter $D_F$ at the surface of the liquid in the intake chamber. Given the range of output at which the drum is intended to operate, it must be ensured both that the intake chamber will be full at the minimum inflow rate and that the vestibule does not overflow at the maximum inflow rate.

The ratio between the two diameters can accordingly be expressed as $$\frac{D_K}{D_F} = \sqrt{\frac{\frac{\rho}{2} \cdot u_1^2 + \frac{P_1}{P_2} \cdot \frac{\rho}{2} \cdot u_2^2 \left[1 - \left(\frac{d_1}{d_2}\right)^2\right] - W}{\frac{\rho}{2} \cdot u_1^2}}$$

where $\rho$ is the density of the centrifugate, $u_1$ is the peripheral speed at diameter $D_K$, $u_2$ is the peripheral speed at the outside diameter of the disk, $P_1$ is the pressue at the outflow end of the intake pipe, $P_2$ is the static pressure at the outside diameter of the disk, $d_1$ is the diameter at which the vestibule will overflow, $d_2$ is the diameter of the disk, and W is the resistance to flow through the drum.

The disk can have radial channels that communicate with flow-off openings on its bottom surface for recirculating centrifugate into the intake chamber. This measure will generate enough turbulence below the disk to prevent product from accumulating in the intake chamber.

The intake chamber in one practical embodiment of the drum in accordance with the invention accommodates, above the channels at its bottom, an annular insert that the intake pipe opens into, and the inside diameter of the insert is selected to convert the pressure of the kinetic energy of the incoming liquid. Since both the kinetic energy of the entering centrifugate and resistance to flow through the drum increase along with the inflow rate, the measure just specified provides a practical compensation for both parameters, and the available pressure will increase along with the resistance.

The vicinity of the intakes into the channels can be designed to promote flow and decrease the entry impact in a practical way.

Some preferred embodiments of the invention will now be specified with reference to the attached drawings, wherein

DETAILED DESCRIPTION OF THE PREFERRED EMBODIMENTS

Figure 1:
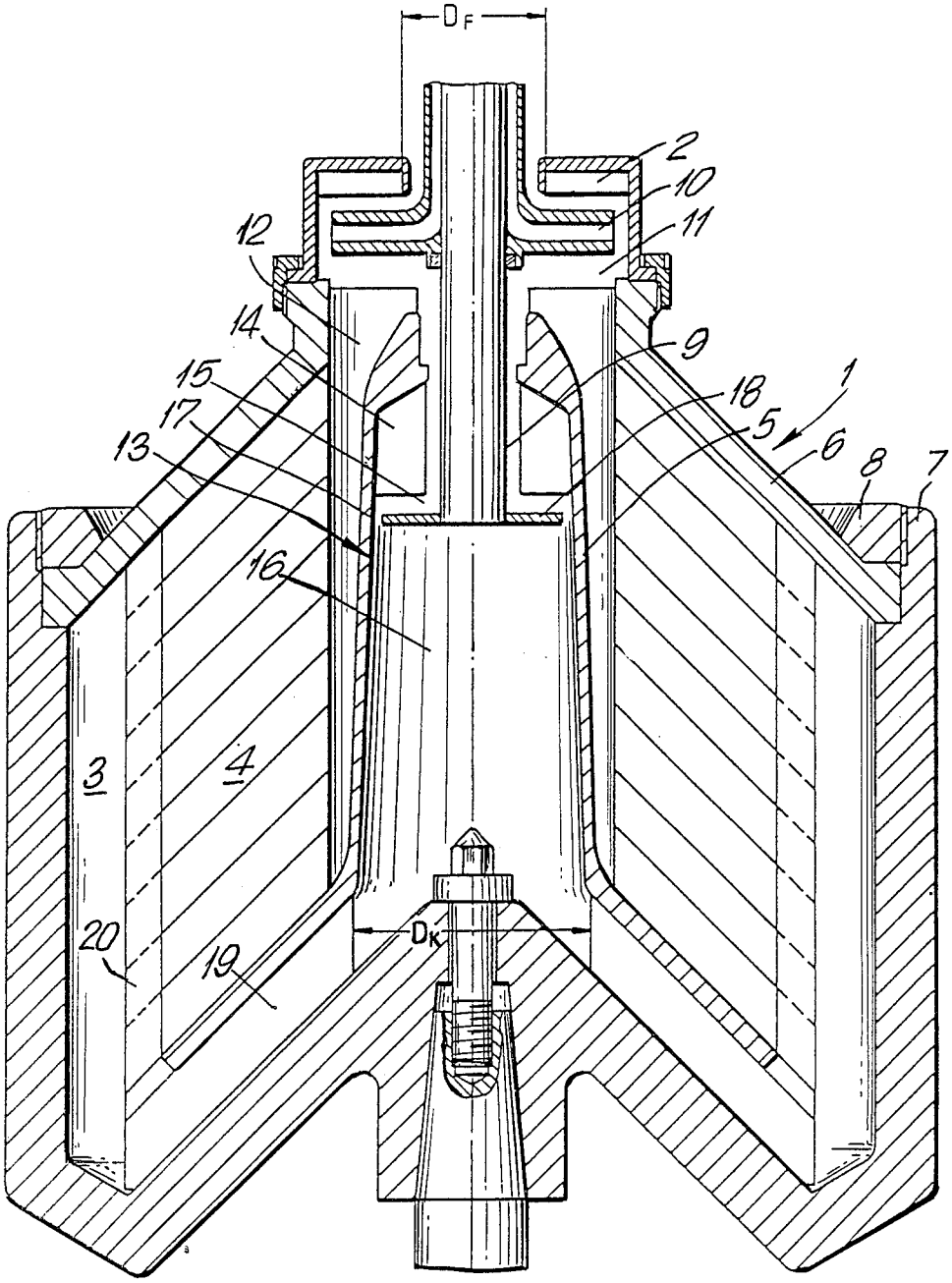
FIG. 1 is a cross-section through the drum.

The rotating centrifuge drum 1 illustrated in FIG. 1 has in the vicinity of its inlet a skimmer 2 that is stationary when the drum is in operation. The drum has a solids space 3 and a separation space, which is occupied by a set of individual disks 4 resting on a distributor 5. The separation and solids spaces are demarcated at the top by the cover 6 and on the bottom by the jacket 7 of drum 1. The cover and the jacket are secured together by a sealing ring In the vicinity of skimmer 2 is a central intake pipe 9, to which is secured a skimming disk 10 that diverts the clarified liquid. The skimming disk is accommodated in a skimming chamber 11 and communicates with the separation space through diversion channels 12. An intake pipe 9 extends into an intake space 13 that consists of a vestibule 15 with ribs 14 and of an unribbed intake chamber 16. Vestibule 15 and intake chamber 16 communicate through an annular gap 17 that is left between the outside diameter of a disk 18 secured to intake pipe 9 and the inside diameter of intake space 13. Channels 19 extend from intake chamber 16 to other channels 20 that rise through set 4 of disks.

Centrifugate is supplied to intake chamber 16 through intake pipe 9 and initially fills solids space 3 through channels 19. It then distributes itself uniformly through rising channels 20 over the total set 4 of disks and arrives in skimming chamber 11 through diversion channels 12. The centrifugate is simultanesously accelerated by channels or ribs to the same angular speed as the drum until the surface of the liquid arrives in the vicinity of intake chamber 16, which does not have any accelerating ribs. Since the centrifugate, which is now filling the intake chamber, can accordingly not generate any rotational pressure, the level of the centrifugate will stop shifting in skimming chamber 11. As soon as the centrifugate in intake chamber 16 arrives at the bottom of intake pipe 9, the liquid pressure prevailing in the pipe will force the centrifugate into vestibule 15 through annular gap 17, where it will be encountered by ribs 14. The resulting rotational pressure will be transmitted through gap 17 to the centrifugate in intake chamber 16, raising the level of centrifugate in skimming chamber 11 until the diameter at its surface equals diameter $D_F$. The highest pressure that can be generated in intake chamber 16 equals the rotational pressure in vestibule 15 just before the latter overflow. An overflow diameter will be selected for vestibule 15 that is preferably short enough for skimming chamber 11 to overflow first subject to all operating conditions.

Figure 2:
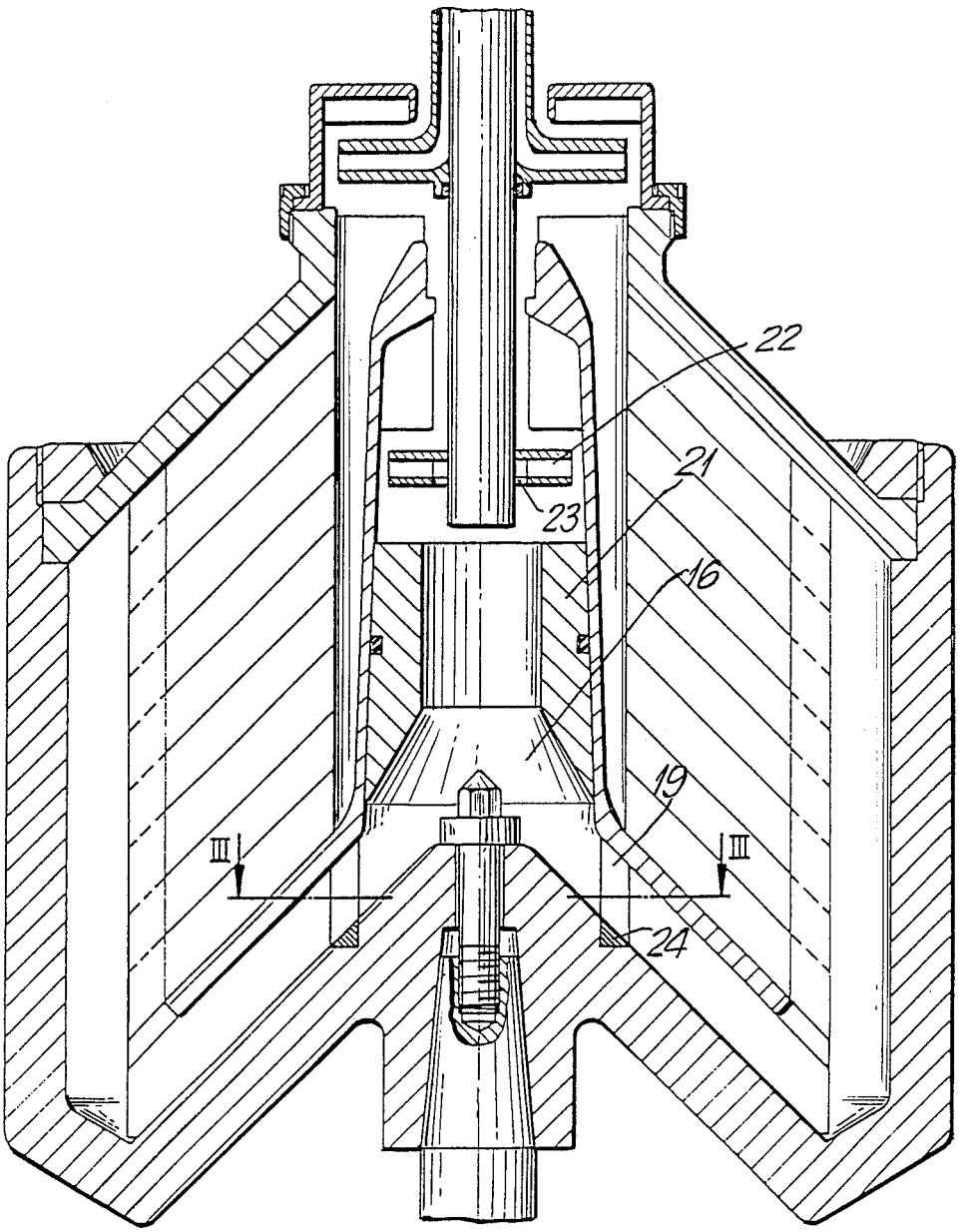
FIG. 2 illustrates the intake space with an annular insert.

FIG. 2 shows the intake chamber 16 above channels 19 and provided with an annular insert 21 that improves the pressure conversion of the kinetic energy in the centrifugate.

Deposits of product in intake chamber 16 below disk 18 can be avoided when disk 18 is provided with radial channels 22 that communicate with outflow openings 23 on the bottom of the disk, generating sufficient turbulence at that point.

Figure 3:
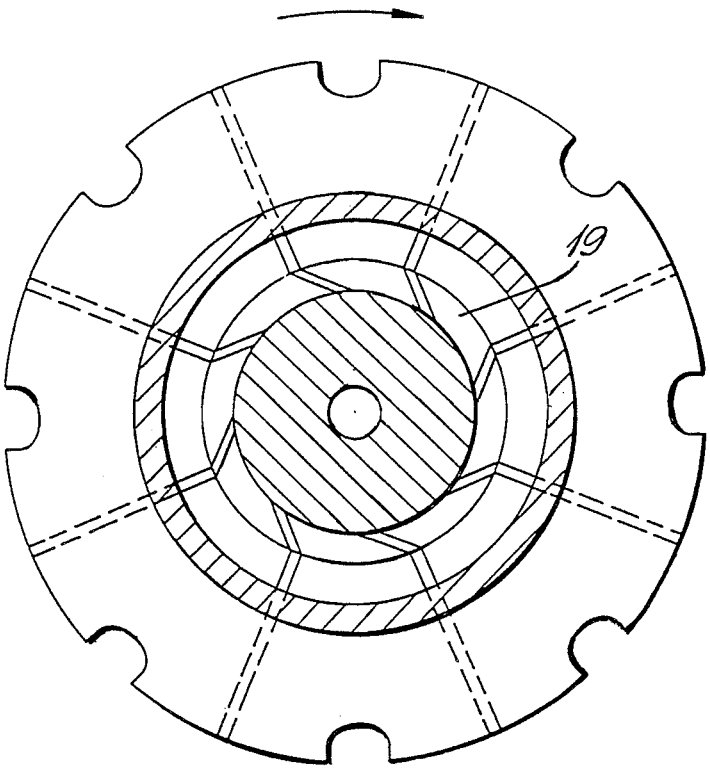
FIG. 3 is a section through the intake space illustrated in FIG. 1.

One section of channels 19 is located in a rib insert 24, where the channels extend backwards in relation to the direction that the drum rotates in to improve uptake of the centrifugate. The shape of these channels will be evident from FIG. 3.

What is claimed is:

1. In a centrifuge drum for clarifying or separating centrifugates, having means forming a separation space, means forming a skimming chamber for receiving liquids from the separation space and having at least one skimmer therein for diverting clarified or separated liquids, means forming an intake space radially within the separation space and which rotates with the drum and includes an intake chamber having a diameter $D_K$ and defined during operation by a liquid surface of liquid not rotating at the same speed as the drum and a vestibule above the intake chamber, a stationary intake pipe extending through the intake space and opening at an outflow end into the intake chamber, means forming channels to provide communication between the intake chamber and the separation space such that a filling of the intake chamber is effective during use, the improvement wherein: the means forming the skimming chamber effects a liquid surface therein having a diameter $D_F$ that must be maintained during operation, the diameter $D_K$ of the intake chamber in the vicinity of the channels is greater than the diameter $D_F$ to produce a choking effect therebetween, and further comprising means forming an annular gap between the vestibule and the intake chamber comprising a disk secured to the intake pipe at said outflow end and having an outer periphery, wherein the annular gap is demarcated by the outer periphery of the disk and an inner surface of the means forming the intake space, and ribs in the vestibule for acting on the liquid therein.

2. The centrifuge drum as in claim 1, wherein the diameter $D_K$ is sufficiently large such that for the centrifugate to rise to a level at which it has a surface diameter $D_F$, the intake chamber, which is completely full of centrifugate, must be subjected to a static pressure generated by the incoming centrifugate, and wherein the ratio of diameter $D_K$ to diameter $D_F$ is $$\frac{D_K}{D_F} = \sqrt{\frac{\frac{\rho}{2} \cdot u_1^2 + \frac{P_1}{P_2} \cdot \frac{\rho}{2} \cdot u_2^2 \left[ 1 - \left( \frac{d_1}{d_2} \right)^2 \right] - W}{\frac{\rho}{2} \cdot u_1^2}}$$

where $\rho$ is the density of the centrifugate, $u_1$ is the peripheral speed at diameter $D_K$, $u_2$ is the peripheral speed at the outside diameter of the disk, $P_1$ is the pressure at the outflow end of the intake pipe, $P_2$ is the static pressure at the outer periphery of the disk, $d_1$ is the diameter at which the vestibule will overflow, $d_2$ is the diameter of the disk, and W is the resistance to flow through the drum.

3. The centrifuge drum as in claim 1, wherein the disk has radial channels that communicate with flow-off openings on a bottom surface for recirculating centrifugate into the intake chamber.

4. The centrifuge drum as in claim 1, wherein the channels are disposed at a bottom portion of the intake chamber and further comprising an annular insert in the intake chamber above the channels and into which the intake pipe opens, wherein the insert has an inside diameter selected to convert the pressure of the kinetic energy of the incoming liquid.

5. The centrifuge drum as in claim 1, further comprising means forming at least one section of the channels to extend backwards in relation to the direction of rotation of the drum.

6. The centrifuge drum as in claim 5, wherein the means forming at least one backwardly extending channel section comprises a rib insert removably secured to the drum.

* * * * *